United States Patent [19]

Wassilieff

[11] Patent Number: 4,691,836

[45] Date of Patent: Sep. 8, 1987

[54] APERTURED CLOSURE DEVICE WITH DEPRESSIBLE DISC PORTION

[76] Inventor: Victor Wassilieff, 84, rue de l'Assomption, 750I6 Paris, France

[21] Appl. No.: 808,667

[22] Filed: Dec. 13, 1985

Related U.S. Application Data

[63] Continuation of Ser. No. 456,114, Jan. 6, 1983, abandoned.

[51] Int. Cl.[4] ..... B65D 39/16

[52] U.S. Cl. ..... 215/298; 215/294; 215/361; 215/363; 220/234; 222/514; 222/525; 222/537; 222/559

[58] Field of Search ..... 215/250, 253, 294, 307–311, 215/355, 363, 364, 341–345, 361, 220, 295, 296, 298; 220/231, 234, 233; 222/525–532, 538, 545, 522, 567, 559, 514

[56] References Cited

U.S. PATENT DOCUMENTS

| | | | |
|---|---|---|---|
| 1,614,236 | 1/1927 | Druiff | 215/364 X |
| 1,651,979 | 12/1927 | Sykes | 220/231 |
| 2,804,242 | 8/1957 | Borah | 222/527 |
| 2,829,380 | 4/1958 | Wood | 220/212 X |
| 2,898,018 | 8/1959 | Borah | 222/530 |
| 2,946,491 | 7/1960 | Bramming | 215/364 X |
| 2,974,835 | 3/1961 | Herbrick | 222/528 |
| 2,977,973 | 4/1961 | Chahine | 215/355 |
| 3,074,580 | 1/1963 | Golde | 215/250 |
| 3,093,273 | 6/1963 | Borah | 222/529 |
| 3,237,816 | 1/1966 | Anderson | 222/545 |
| 3,319,842 | 5/1967 | Miller | 222/545 |
| 3,321,114 | 5/1967 | Croyle | 222/514 |
| 3,439,893 | 4/1969 | Corsette | 222/559 |
| 3,672,114 | 6/1972 | Sachs | 220/231 X |
| 3,809,275 | 5/1974 | Ek | 215/309 |

FOREIGN PATENT DOCUMENTS

| | | | |
|---|---|---|---|
| 243991 | 10/1962 | Australia | 215/220 |
| 105843 | 1/1958 | Norway | 215/354 |

*Primary Examiner*—Stephen Marcus
*Assistant Examiner*—Bryon Gehman
*Attorney, Agent, or Firm*—Kane, Dalsimer, Kane, Sullivan and Kurucz

[57] ABSTRACT

A closure device for a receptacle is provided with a first generally annular member adapted to be fixed to the receptacle across the opening thereof. A second generally annular member is substantially coaxial with the first annular member and is adapted to be axially moved between an inward closed position and an outer open position. An elastically deformable annular membrane member has one end fixed relative to the first annular member and another end for retaining the second annular member. A fluid passageway in the closure communicates with the container interior when the first annular member is in the open position. Valve means cooperates with valve seat for closing off the passageway when the first annular member is in a closed position.

3 Claims, 23 Drawing Figures

APERTURED CLOSURE DEVICE WITH DEPRESSIBLE DISC PORTION

This is a continuation of co-pending application Ser. No. 456,114 filed on Jan. 6, 1983, now abandoned.

BACKGROUND OF THE INVENTION

The present invention relates generally to a closure device for receptacles for a fluid or other flowable material.

Several closure devices for the outlet apertures of such receptacles have already been proposed. Such closure devices usually comprise a stopper which is clamped or screwed on or in the neck of a bottle or the aperture of a can, or the like.

I have proposed in my French Pat. No. 2,077,840 published on Nov. 5, 1971 an improved closure device comprising a cylindrical sidewall, a central transverse wall axially extending across the sidewall, an axially resilient sealing flange radially extending from the outer end of the sidewall for sealing engagement with an inwardly turned rim at the free end of the neck of the associated bottle and a radially outwardly projecting second sealing member axially spaced from the sealing flange for sealing contact with a corresponding internal wall portion of the collar of the bottle and for defining a detent for maintaining the closure device in the mouth of the bottle against the resilient action of the sealing flange.

Although providing good sealing, such closure devices, as well as other known closure devices, present some drawbacks.

Such closure devices must be removed from the bottle mouth to gain access to the contents of the bottle and therefore are easily misplaced or even lost. Further such devices cannot be easily adapted to be made childproof for, e.g., dangerous contents or medicines. Moreover, such known closure devices cannot be adapted to bottles having slightly different aperture diameters. Further, tamper-proof features for such known closures are usually of complex construction and/or disposed outwardly of the closure device thereby increasing external dimensions.

SUMMARY OF THE INVENTION

It is thus the object of the invention to provide a closure device easy to operate, of simple structure and low cost, which cannot be lost or misplaced when opened providing access to the contents of the associated receptacle.

According to the invention there is provided a closure device for a fluid receptacle having an outlet aperture, said closure device comprising a first generally annular member fixed relative to the receptacle adjacent the aperture in the receptacle, a second generally annular member substantially coaxial with said first annular member, said second annular member being axially movably mounted between an axially inward closed position and an axially outward open position, an elastically deformable annular membrane member having one end fixed relative to said first annular member and another end for retaining said second annular member, portions of at least two of said members defining a fluid passageway for communication between the interior of the receptacle and the surroundings for discharging fluid from the receptacle when said first annular member is in the open position, and valve means defined by one of said second annular member and said membrane member cooperable with a valve seating for closing off the passageway in the closed position of said first annular member.

Thus with the closure device according to the invention the second annular member is retained relative to the rest of the closure device so that even when the closure device is open for dispensing the fluid contents of the associated receptacle no part of the closure device can be misplaced or lost.

Further, owing to the provision of the elastically deformable membrane member improved sealing is provided over known closure devices. In addition, with the novel membrane member it is possible to define the open and closed positions of the movable member.

According to a preferred aspect of the invention, the membrane member is molded substantially in the closed position of the membrane member so that the closed position is more stable than the open position. In addition, the closed position of the membrane is selected intermediate the closed position of the movable member and the molded configuration, and immediately above the latter so that the membrane member forces the movable member axially against the valve seating for tightly sealing off the passageway.

Further, the membrane member is advantageously composed of one-piece molded construction with the fixed member and the movable member being integral with the membrane member or separate therefrom. According to some preferred arrangements the fixed member, the membrane member and at least part of the movable member are of one-piece molded construction.

DESCRIPTION OF THE PREFERRED EMBODIMENTS

FIGS. 1-3 and 7-9 illustrate various embodiments of the closure device of the invention adapted for the necks of bottles, e.g., of glass as illustrated. It will be readily appreciated that such embodiments may be used as closure devices for other kinds of receptacles or containers.

Figure 1A:
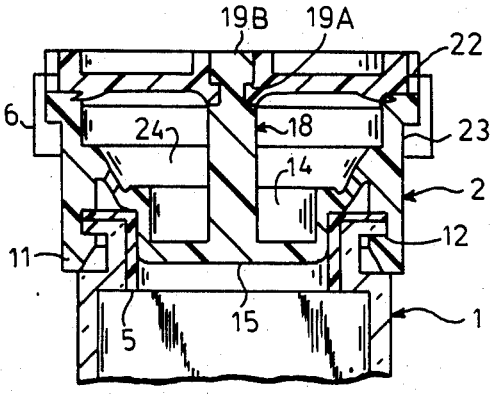
FIG. 1 shows a split longitudinal sectional view of a first embodiment of the present closure device, the left-hand side illustrating the closed position and the right-hand side illustrating the open position.
Figure 1B:
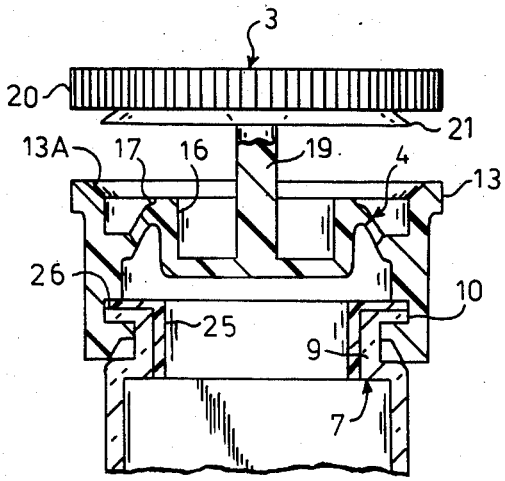

In FIG. 1 is shown the neck 1 of a bottle having a collar generally designated by reference 7 defining an orifice or aperture of the bottle. The collar 7 comprises a cylindrical wall 9 connected by a short annular wall portion to the rest of the neck 1 and an outwardly extending transverse rim 10 at the opposite end thereof.

The closure device comprises a first generally annular member 2 adapted to be fixed to the bottle, a second generally annular member 3 mounted for axial movement relative to the first annular member 2 and a deformable annular membrane member 4 attached at its radially outer periphery to the first or fixed member 2 and at its radially inner periphery to the second or movable member 3.

The fixed member 2 comprises a generally cylindrical skirt having an annular interlocking means 11 opposite the cylindrical wall 9 of the collar 7 and elastically clipping the underside of the transverse rim 10. An annular groove 12 adjoining the hooking portion 11 is shaped to elastically engage the peripheral edge of the rim 10. At the upper end of the skirt of the fixed member 2 is provided an outwardly turned rim 13 and beveled pouring surface 13a flaring outwardly toward the rim 13.

The second or movable member 3 of the closure device comprises seal means formed by an outwardly opening stopper having an end wall 15, an upwardly extending cylindrical wall 16 joined to the radially inner periphery of the membrane member 4 by a connecting zone 17. The movable member 3 is provided with an operating member generally designated by reference 18 and comprising an axial stem 19 attached to the end wall 15 of the stopper at one end, and at the other end, a recessed disc-like grip member 20 having a knurled periphery and a diameter substantially equal to the outer diameter of the skirt rim 13. A downwardly and outwardly inclined flexible sealing lip 21 is integrally formed on the underside of the grip member 20 for sealing engagememt with the beveled surface 13 at the upper end of the skirt of the fixed member 2.

The flexible membrane 4 has an upwardly tapering frustoconical configuration in its first or rest stable position and comprises one or more ports 24 disposed in the fluid passageway communicating with the interior of the receptacle and the surroundings in the open position of the closure device.

As illustrated, the fixed member 2, the movable member 3 and the membrane member 4 are of one-piece molded plastic construction. On the other hand, the disc-like grip member 20 is preferably connected at the frustoconical upper end or tip 19B of the stem 19 of the movable member 3. For assembly, the grip member 20 is simply slid into position in the annular groove 19A adjoining frustoconical upper end 19B of the stem 19, and maintained in place by the shoulder and adjoining groove 19B formed by the frustoconical tip 19B of the stem.

Preferably as shown in FIG. 1, an annular plastic liner 5 comprises a cylindrical portion 25 adapted to line the cylindrical wall 9 of the bottle collar and a radially outwardly extending transverse portion 26 overlying the upper surface of collar the rim 10. This liner 5 formed of a low friction plastic material and is adapted to define a valve seating cooperable with the upwardly extending cylindrical wall 16 and the connecting zone 17 between the movable member 3 and the membrane member 4. The liner 5 improves sealing contact with the stopper formed on the movable member 3. Alternatively, no liner may be employed in which case the connecting zone 17 and the cylindrical wall 16 come into direct contact with the rim 10 and the axial cylindrical wall 9 of the collar 7.

To close the closure device force is exerted inwardly on the grip member 20 which brings the movable member 3 and the membrane member 4 in the position illustrated to the left in FIG. 1. In the course of travel from the open position to the closed position the membrane member flips over and reverses its shape to an inwardly tapering frustoconical configuration. The connecting zone 17 defines an axial abutment with transverse portion 26 of the insert so that the membrane member 4 is biased against the transverse portion 26 to ensure a stable fluidtight closed position. The cylindrical outer surface of wall 16 is in snug sealing engagement with the corresponding surface of the cylindrical portion 25 of the liner 5.

In the embodiment of FIG. 1 there is provided a tamperproof frangible ring 6 which is integrally molded with the disc-like grip member 20 and joined thereto by a plurality of circumferential tones 22 of reduced strength. The frangible ring comprises a circumferential interlocking portion 23 adapted to engage the underside of the rim 13 for holding the movable member 3 in the closed position until purchase of the bottle by the ultimate user to guarantee integrity of each contents. The frangible zone 22 is severed to permit the grip member 20 and thereby the movable member 3 to move upwardly to the open position. The frangible zone 22 may have a tab or the like to facilitate severing. The tamper evident ring is only a preferred feature and may be omitted whenever unnecessary.

Figure 2A:
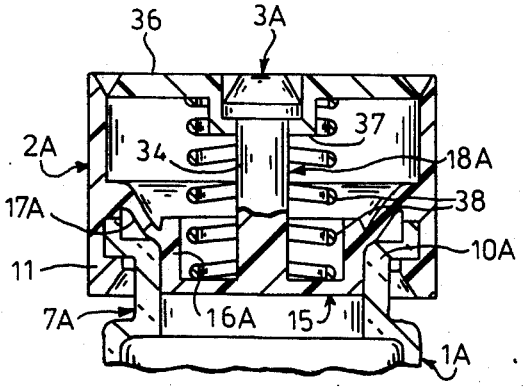
FIG. 2 shows a split longitudinal sectioned view of an embodiment of the present closure device with a depressible childproof disc, the left-hand side illustrating the disc in its closed position and the right-hand side illustrating the disc depressed.
Figure 2B:
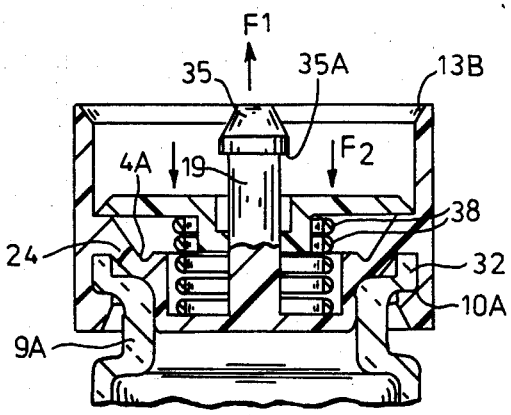

FIG. 2 shows a second embodiment of the closure device of the invention which is a modification of the FIG. 1 embodiment which is child-resistant. Like parts in this other figure are designated by the same reference numerals as in the embodiment of FIG. 1, and only the modified parts will be described in detail.

The bottle 1A has a different collar 7A in which an upturned cylindrical rim 32 is provided at the periphery of the transverse rim portion 10 of FIG. 1 embodiment. The groove is the fixed member 2A is modified to accommodate the upturned rim portion 32 and part of the transverse rim portion 10A. The fixed member 2A has a rimless skirt with a beveled pouring surface 13B.

In lieu of the disc-like grip member of FIG. 1 there is provided a frustoconical tip 35 at the upper end of the stem 18A adapted to be grasped by the user's fingers, under the shoulder 35A between the stem and the frustoconical tip 35.

There is provided a closure partition or disc 36 having a central recess 37 adapted to accommodate the frustoconical tip 35 of the stem 19 and resilient means such as a coil spring 38 bias the bottom wall of the recess 37 of closure disc 36 into abutment with the shoulder 35A. To permit access by an adult the closure disc 36 is depressed in the direction of arrow F2 as shown to the right in FIG. 2 to permit the frustoconical tip 35 and stem 18A to be grasped by the user's fingers, whereupon the movable member 3A can be lifted to the open position substantially as shown to the right in FIG. 1. A child will be unable to open the closure device since it requires the coordinated movement of the depression of the closure disc 36 and raising of the operating member 18A. Such a closure member is therefore ideally suited for medicine jars and the like. Furthermore, since the transverse outer surface of the closure disc 36 is generally flush with the free end of the frustoconical tip and the upper edge of the skirt of the fixed member 2A there is virtually no risk of a child's finger grasping the operating member 18A.

The operation of the closure device of the FIG. 2 embodiment is otherwise like that of the FIG. 1 embodiment described above. It should be noted, however, that as shown in the closed position of the movable member 3A, the valve means includes the radiused connecting zone 17A between the membrane member 4A and the cylindrical wall 16A of the movable member 3A which mates with the complementarily radiused portion 10A between transverse and cylindrical portions 10A and 9A, the collar 7A to enhance sealing engagement under the axial biasing action of the membrane member 4A.

Figure 3A:
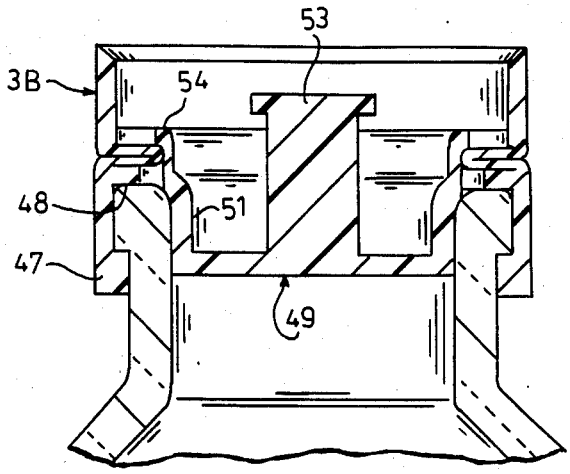
FIG. 3 is a split view similar to FIG. 1 for another embodiment having a bellows membrane member.
Figure 3B:
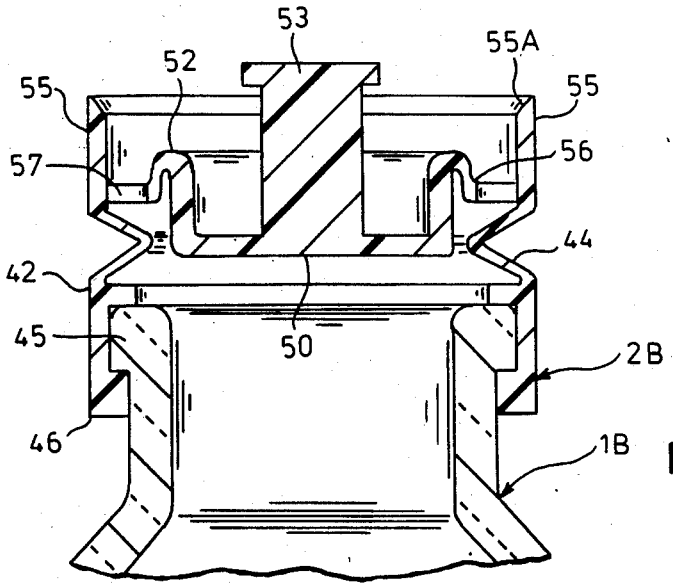

In the FIG. 3 the bottle has a bead 45 around the mouth of the neck 1B. The first fixed annular member 2B comprises at its lower periphery an annular interlocking portion 47 adapted to engage by detent action the underside 46 of the bead 45 for securing the fixed member to the bottle 1B. Circumferential wall 48 extends radially inwardly of the skirt of the fixed member 2B to define with the hooking portion 47, a circumferential recess for accommodating the projecting portion of the bead 45. The membrane member comprises an axial bellows 44 having a single radially inwardly projecting fold as shown. The lower periphery of the bellows 44 is joined to the fixed member 2B and the upper periphery of the bellows 44 is joined to a skirt 55 with a pouring lip 55A which is part of the movable member. The movable member 3B comprises a central stem 53 with a small knob 58 at its outer end to facilitate grasping a stopper. The stopper comprises a bottom wall 50, a cylindrical sidewall 51 having a diameter size for defining a snug fit with the inner wall of the neck 1B adjacent the aperture of the receptacle to sealingly engage the latter in the closed position of the movable member 3B. As shown to the left of FIG. 3, this snug fit determines the second stable position of the bellows 44. An annular transverse wall 56 extending radially inwardly from the skirt 55 is provided with one or more ports 57 along the fluid passageway. The cylindrical wall 51 of the stopper is joined to the transverse wall 56 by a flexible connecting zone 52 which is U-shaped in section at rest in the open position.

The movable member 3B is closed by depressing the same until the closed position to the left in FIG. 3 is reached. In this position the upper part of the bellows immediately underlying the port 57 closes off the same and the flexible connecting zone 52 is pulled open around the fold in the bellows 44. The closure device is opened by pulling up the movable member 3B to the position shown to the right in FIG. 3 thereby permitting flow of the fluid through the port 57 along skirt 55 to lip 55A.

Figure 4A:
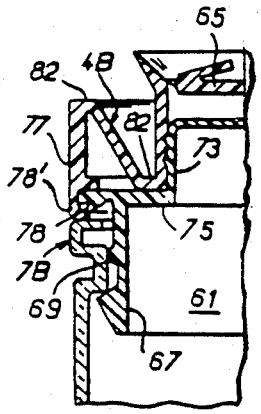
FIG. 4 is a split view similar to FIG. 1 for another embodiment having a collapsible spout.
Figure 4B:
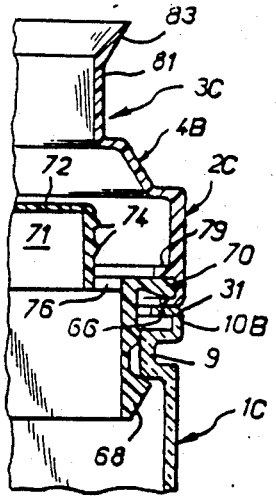

The FIG. 4 embodiment shows a closure device which is particularly adapted to a bottle having a neck with a collar 7B of S-shaped cross-section, having a radially inwardly projecting rim 66 at the free end of the cylindrical portion 31 of the collar 7A shown in FIG. 2. The neck is shown as 1C in FIG. 4.

A fixed hollow plug 61 is received in the aperture of the bottle and comprises a depending cylindrical skirt 67 detented to the portion 10B by an outwardly projecting annular hooking portion 68. An annular rib 69 on the skirt 67 sealingly engages the cylindrical surface 9 of the collar. The plug 61 further comprises an annular transverse wall 75 joined at the upper end of skirt 67 having a resilient bead 70 at its outer periphery and an upwardly protruding cylindrical boss 71 at its inner periphery. One or more ports 76 are formed in the transverse wall 75 in the fluid passageway in communication with the interior of the bottle. The boss 71 comprises a cylindrical sidewall 73 with axially spaced annular sealing ribs 74 and an end wall 73.

The fixed member 2C comprises a cylindrical skirt 77 having at its lower end a hooking portion 78' which forms in association with an inwardly extending transverse rib 79 a profiled groove 78 shaped to mate with the bead 70 on the transverse wall 75. When the plug 61 is introduced into the mouth of the bottle with the fixed member 2C secured thereto the interlocking portion 78' is urged against the projecting rim 66 of the collar.

A radial connecting zone 80 joins the upper end of skirt 77 to the outer periphery of membrane member 4B which is devoid of ports and a narrow annular connecting zone 82 joins the inner periphery of the membrane member 4B to movable member 3C comprising a cylindrical spout 81 having a flared pouring lip 83. The spout 81 and membrane member 4B together constitute a collapsible spout.

In the closed position shown to the left in FIG. 4 the annular zone 82 abuts against the transverse wall 75 to define a stable position of the inwardly converging frustoconical membrane member 4B. The inner wall of the spout 81 is in sealing engagement with the cylindrical sidewall 73 of plug 61, the diameters of the sidewall 73 and the spout 81 being selected to define a snug fit. The closure device may be opened by pulling the collapsible spout upwards to the extended position shown at the right in FIG. 4.

Preferably as shown on the left-hand side of FIG. 4 there is provided a tabbed tamperproof seal 65 having a frangible connecting zone with the spout 81 at the junction with the pouring lip 83.

Figure 5A:
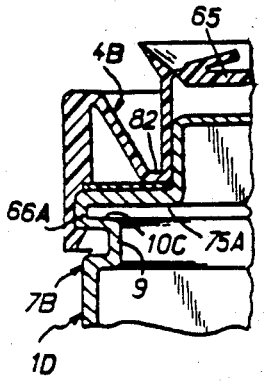
FIG. 5 is a split view similar to FIG. 4 showing a modification thereof.
Figure 5B:
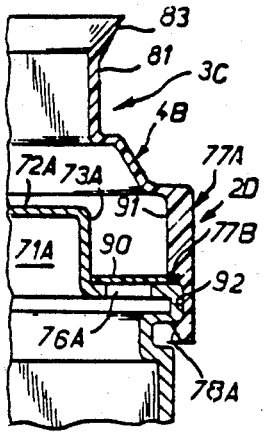

FIG. 5 is a modified version of the FIG. 4 embodiment in which, instead of a plug adapted to be detended in the mouth of the bottle, the receptable compises a container, e.g. of metal or plastics material, with an integrally formed plug 71A having one or more ports 76A in the transverse wall 75A at the upper end of the S-shaped collar 78A on the neck 1D of the container. In addition, the port or ports 76A also comprise the aperture bringing the interior of the container into communication with the fluid passageway. Further, a flat annular check valve member 90 overlies the transverse wall 75A and is clamped in place at its outer periphery between circumferential shoulder 77B on the skirt 77A of the fixed member 2D and the radially outer end of the transverse wall 75A. A modification of inwardly projecting rim 66 of FIG. 4 is shown as 66A in FIG. 5. The skirt 77A is clipped under the transverse wall 10C of the collar 7C by an annular interlocking portion 78A, having a groove 92 shaped to mate with ports 10C and 31 of the container collar 78A. Once the tamper proof seal 65 is removed and the collapsible spout extended, as shown to the right in FIG. 5, the container may be tipped to pour out the liquid, the check valve member 90 being free along its inner periphery to deform to cupped configuration by the flow of liquid from the container. The check valve member 90 prevents unauthorized refilling of the container.

Figure 6A:
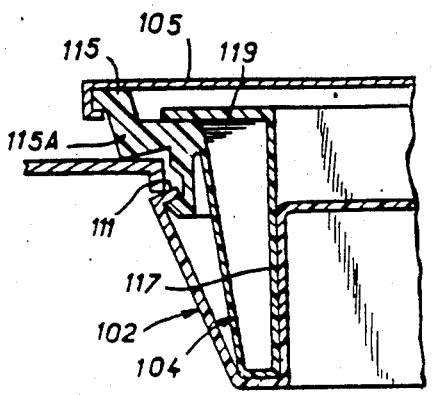
FIG. 6 is a split view similar to FIG. 4 showing a modification thereof with a tamperproof capsule.
Figure 6B:
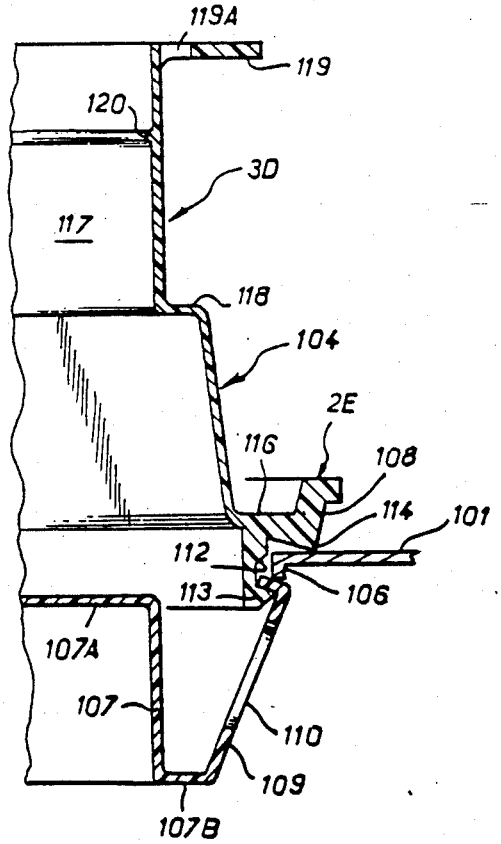

FIG. 6 is a further modified embodiment of the general type of the closure devices of FIGS. 4 and 5 which is adapted to an opening in a flat container wall 101 of, e.g., a metal can. In the FIG. 6 embodiment the plug 102 is accommodated inside the container and comprises a central boss having a cylindrical sidewall 107 and circular endwall 107A connected to the upper end of the sidewall 107, and an annular connecting zone 107B at the lower end of the sidewall 107 joining a frustoconical outer wall 109 flaring from the connecting zone 107B to an inturned flange 111. The outer wall 109 has one or more ports 110.

The fixed member 2E comprises a resilient clipping member for securing the plug 102 and the rest of the closure device to the wall 101 of the container. The clipping member interlocking portion 113 cooperating with the inturned flange 111 of plug 102 and a radially opening channel 112 for receiving the free end inturned flange 111. The clipping member further comprises a generally radial portion extending outwardly from the axial portion and including a circular bearing ridge 114 and an outwardly projecting rim 115 at the periphery of a flared connecting zone 115A, and an annular upper bearing surface 116.

The movable member 3D comprises a cylindrical spout 117 having a circular tab 119 inwardly defined by a nearly complete annular slot 119A closed at one end for grasping the same. An annular sealing rib 120 is disposed on the inner wall of the cylindrical spout 117 for enhancing sealing engagement with the cylindrical sidewall 110 of the plug 102. An annular connecting zone 118 joins the spout 117 to the membrane member 104. As the axial length of the spout 117 and the membrane member 104 is greater than the corresponding parts of the FIGS. 4 and 5 embodiments, the resulting spout in extended position is correspondingly longer as is useful for dispensing certain liquids such motor oil.

In the closed position of the closure device the tab 119 bears against the upper bearing surface 116 on the radial portion of the clipping member. The lower part of the collapsed spout is received in the annular spaced defined by parts 107, 107B and 109 of the plug 102, with the cylindrical spout 117 in sealing engagement with the sidewall 107 of the central boss, and the connecting zone 118 in engagement with the complementary connecting zone 118 between sidewall 107 and frustoconical outer wall 109 of the plug.

A tamperproof or guarantee capsule 105 may be crimped on the projecting rim 115 of the clipping member as shown in lieu of a tamperproof seal for closing off the spout 117 as shown in FIGS. 4 and 5.

Owing to its resilient construction of its component parts the closure device is assembled first and then inserted in its closed position into the aperture in the wall 101 of the container. Once inserted, the resilient clipping member urges the inturned flange 111 against the depending rim 106 defining the aperture in the wall 101, and the radial portion of the clipping member biasing the ridge 114 into firm contact with the outer surface of the wall 101. The opening and closing of the closure device is otherwise as described above with respect to the FIGS. 4 and 5 embodiments.

Figure 7A:
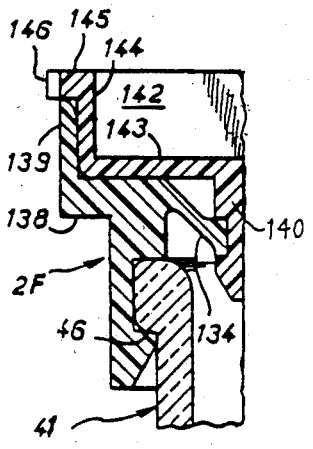
FIG. 7 is a split view similar to FIG. 1 for still another embodiment.
Figure 7B:
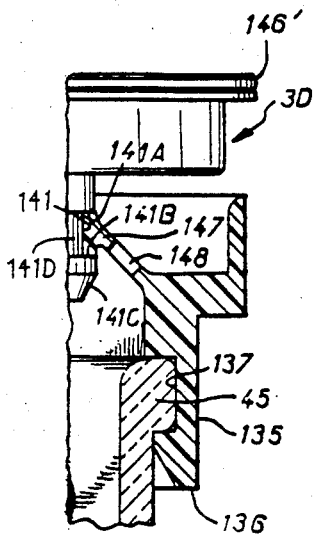

In FIG. 7, the fixed member 2F comprises a depending skirt 135 having an annular interlocking portion 136 adapted to engage shoulder 46 under the bead 45 at the mouth of the neck 41 of a bottle. The bead 45 is received in the radially inwardly opening groove 137 in the skirt 135 adjoining the shoulder formed by the interlocking portion 136. The fixed member 2F further comprises an upwardly opening recess defined by a cylindrical sidewall 139 adjoining an annular transverse wall 138.

The movable member 3D comprises an upwardly opening cup-shaped stopper 142 having a bottom wall 143, a sidewall 144 and a radially outwardly extending peripheral rim 145 having vertical knurling as shown at 146 (at the right) or horizontal ribbing 146' (at the left), for facilitating the grasping of the rim 145 of stopper by the user to open the closure device. The movable member 3D further comprises an axial stem 140 having circumferential outwardly opening groove 141 bounded by the axial spaced shoulders 141A and 141B formed on the larger diameter upper portion of the step 141 and upper end of the generally frustoconical lower end 141C of the stem 141, respectively.

The frustoconical member 134 tapering downwardly in the closed position and tapering upwardly in the open position of the closure device is joined at its outer periphery to the fixed member 2F and has at its inner periphery a cylindrical collar 147 tightly received in the groove 141 around the narrow stem portion 141D between the shoulders 141A and 141B. The membrane member 134 has one or more ports 148 for providing communication between the interior of the bottle and the surroundings in the open position of the closure device.

In this embodiment the sealing engagement of the outer surface of the sidewall 144 and bottom wall 143 of the stopper with the inner surface of the sidewall 139 and the transverse wall 138 of the fixed member closes off the fluid passageway between the interior of the bottle and the atmosphere in the closed position of the closure device. The rim 145 bears against the upper edge of sidewall 139 in the closed position. The outer diameter of sidewall 144 and the inner diameter of sidewall 139 are sized to provide snug engagemnt.

Figure 8A:
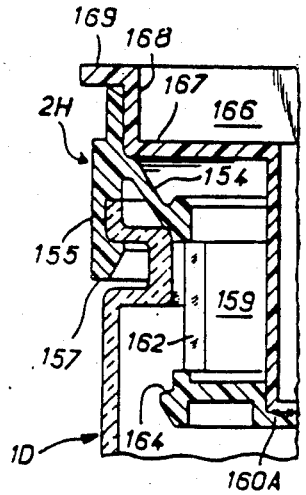
FIG. 8 is a split view similar to FIG. 1 for yet another embodiment in which the movable member comprises a stopper and metering chamber.
Figure 8B:
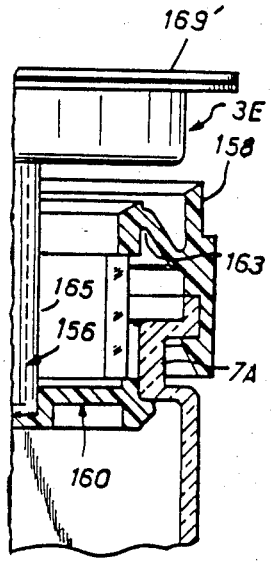

The embodiment of FIG. 8 illustrates a closure device for metering the fluid dispensed by the receptacle. This embodiment for the closure device is illustrated with a bottle with a neck 10, and having a collar 7A as illustrated in FIG. 2 and described above.

The fixed member 2H comprises a cylindrical skirt 155 having an annular interlocking portion at its lower end 157 for clipping the rim of the collar 7A to firmly secure the fixed member 2H to the bottle. The fixed member has an upstanding sidewall 158 slightly radially recessed relative to the outer surface of the skirt 155. The outer periphery of the membrane member 154 is joined to the fixed member 2H and the inner periphery of the membrane member 154 is integral with the upper end of a cylindrical metering compartment 159 having a lower end wall 160 with an annular downwardly opening recess. An annular abutment shoulder 164 is formed at the outer periphery of the lower end wall 160 for sealing engagement with a corresponding connecting zone of the collar 7A along generally axial and radial surfaces. The compartment 159 has one or more elongated axial ports 162 (two shown) permitting communication with the interior of the bottle in the closed position. The fixed member 2H, the membrane member 154 and the metering compartment 159 are preferably of one-piece molded plastic construction as shown.

In this embodimemt, the movable member 3E comprises the compartment 159 and the operating member 156 including a hollow central stem 165 bonded at its lower end to a complementary central recess 160A in the upper side of the end wall 160. The operating member 156 further comprises an upwardly opening hollow stopper 166 having a bottom wall 167 forming a radially outward continuation of the upper end of the stem 165 and an upstanding sidewall 168 which in turn is continued radially outwardly by a flat rim 169. The rim 169 may be horizontally ribbed as shown to the right in FIG. 8 as 169'.

The metering closure device of FIG. 8 operates as follows. In the closed position the fluid in the bottle communicates with the metering chamber defined by compartment 159, the membrane member 154, the outer surface of hollow stem 165 and bottom wall of stopper 166. In the closed position the stopper is in snug sealing engagement with the sidwall 158 and the radiused connecting zone with the adjoining membrane member 154. To dispense the metered quantity of fluid the operating member is pulled outwards bringing the abutment 164 into sealing engagement with the collar 7A, whereupon the metered fluid is dispensed through the open upper end of the cylindrical compartment 159 beneath the under surface of the stopper and beyond the upstanding sidewall 158.

Figure 9A:
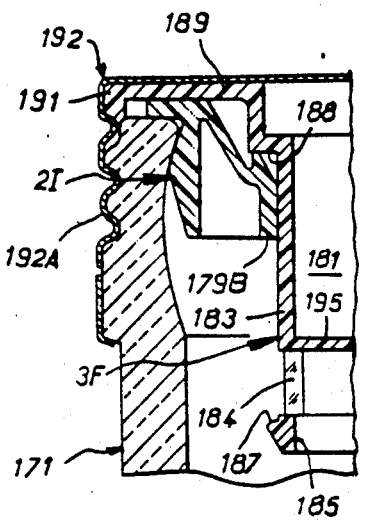
FIG. 9 is a split view similar to FIG. 1 for an embodiment in which a cap is provided on the movable member for threaded engagement with the neck of the bottle.
Figure 9B:
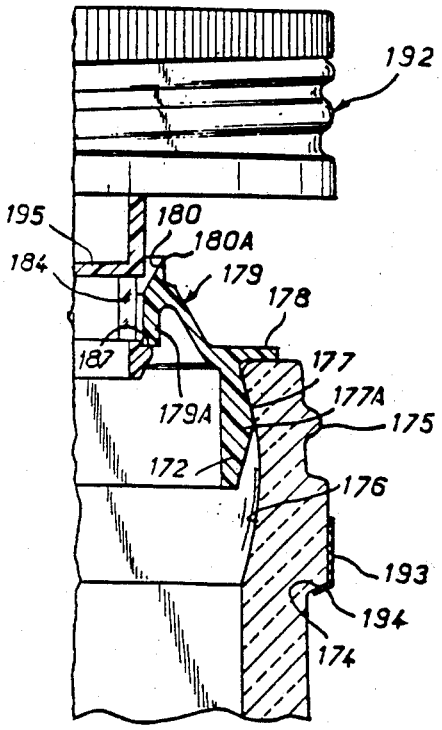

The embodiment of FIG. 9 is generally of the type illustrated in FIG. 8 and described above, adapted for a bottle having a threaded neck 171. In FIG. 9, the bottle neck 171 has toroidal inner surface 176 and one or more integrally formed screwthreads 175.

The fixed member 21 comprises a skirt 172 having an outer surface comprising a downwardly flared portion 177 followed by a downwardly tapering portion 177A, and a radially outwardly protruding transverse wall 178 adapted to bear against the free end of the bottle neck defining the aperture. As shown in FIG. 9 the skirt portion 177 resiliently engages the toroidal inner surface 175 of the neck 171, securely fastening the fixed member at the mouth of the bottle.

The membrane member 179, of downwardly tapering frusto conical configuration in the closed position (left side of FIG. 9), extends from the radially inner periphery of the transverse wall 178 into a depending tubular portion 179A. The tubular portion 179A is continued upwardly along its inner surface by a beveled pouring lip 180 having a free edge 180A.

In this embodiment the movable member 3F is secured to the underside of a screw cap 192 which is preferably of thin metal construction with one or more screwthreads complementary to the screwthread or screwthreads 179 on the bottle neck 171. The movable member comprises a central tubular member 183 having a lower endwall 182 with a central port 185 permanently in communication with the interior of the bottle. A projecting annular abutment shoulder 187 is provided at the adjacent the lower end of the tubular member. Slightly above the lower end of the tubular member 183 is provided one or more discharge orifices 184 (two shown) slightly above the open lower end 185 of the tubular member 183 which will be explained below; a transverse wall 195 is provided just above said orifices 184. The tubular member 182 is radially extended by a shoulder 188 at its upper end, the shoulder 188 being in engagement with the pouring lip edge 180A in the closed position and continues upwardly to an annular wall 189 in contact with the underside of the top of cap 192 to which it is bonded. The annular wall 189 is continued radially outwardly in sealing engagement with the upper surface of the transverse wall 178 and then widens into a thick bead 191 which is in resilient engagement between the underside of the top of the cap 192 and the uppermost portion of the screwthread 192A. The thread 192A on the cap 192 is formed with the annular wall 189 and bead 191 in position in the cap so that the bead will be axially crimped between the underside of the top of the cap and the uppermost part of the thread 192A.

In the closed position of the closure device of FIG. 9, the wall 189 of the movable member 3F is in sealing engagement with the upper of the transverse wall 178, the pouring lip edge 180A and the inner surface of the tubular portion 179A preventing the flow of fluid between the single component formed by the fixed member 3F, the membrane member 179 and the tubular portion 179A.

The cap 192 is preferably provided at the lower end of its skirt with a guarantee ring 193 having an inturned edge 194 crimped under the complementary shoulder 174 on the neck of the bottle. The guarantee ring 193 is connected to the rest of the cap 192 by a frangible zone adapted to be severed when the user starts unscrewing the cap, as is well known in the art. The axial distance between the shoulder 187 and the edge 179B is selected so that the cap has been completely unscrewed when the abutment shoulder 187 at the lower end of the tubular member 182 is in abutment with the lower edge 179B of the tubular portion 179A, whereupon the user displaces the cap upwardly, swinging the membrane member 179 from its first stable position in which it is downwardly tapering to its second stable position in which it is upwardly tapering. The upward displacement of the movable member 3F is limited by abutment of the shoulder 187 with the lower edge 179B of the tubular portion 179A. In its raised second stable position the membrane member 179 maintains the movable member 3F and cap 192 in the open position.

The contents of the bottle can then be poured by tilting the bottle to permit the fluid to pass through the free lower end 195 of tubular member 183 and through the discharge orifice 184 and the remaining portion of the flow passageway between the tubular member 183 and the tubular portion 179A and then over the pouring lip 180 out of the closure device. The transverse wall 195 prevents the flow of fluid contents into the tubular member 183 which would otherwise preclude dispensing of all the fluid contents from the receptacle.

Figure 10A:
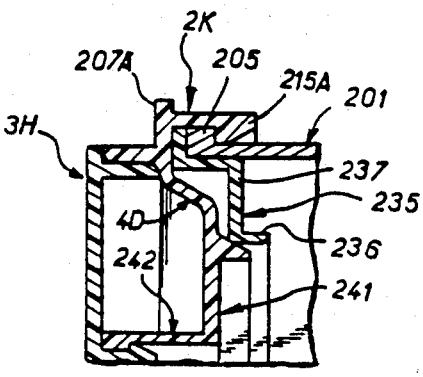
FIG. 10 is a split view similar to FIG. 1 for a closure device comprising a tap for a pipe.
Figure 11:
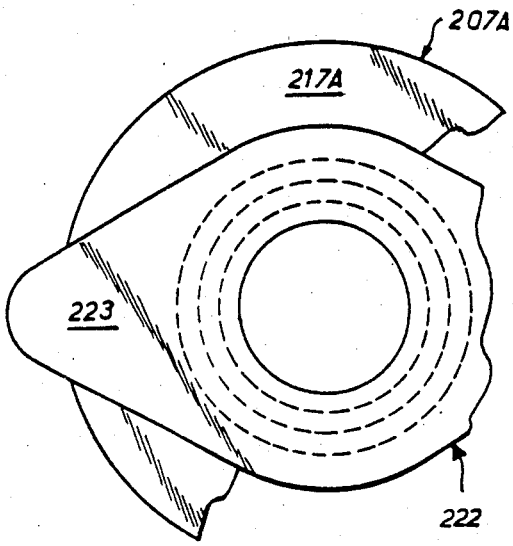
FIG. 11 is a partial end view of the closure device fo FIG. 12.
Figure 10B:
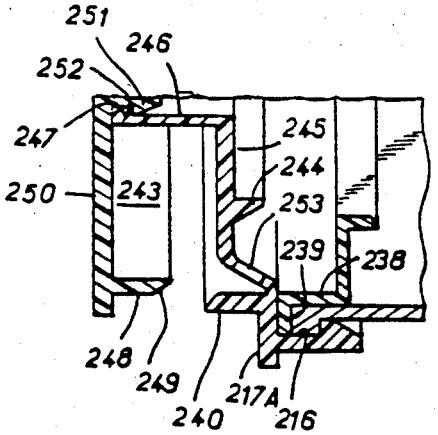
Figure 12A:
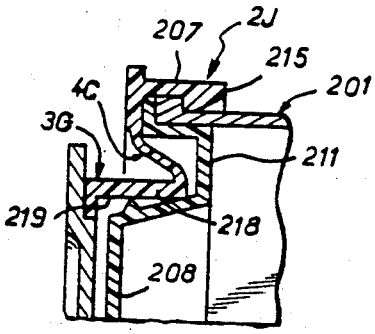
FIG. 12 is a split view similar to FIG. 1 for another embodiment of the closure device comprising a tap for a pipe.
Figure 12B:
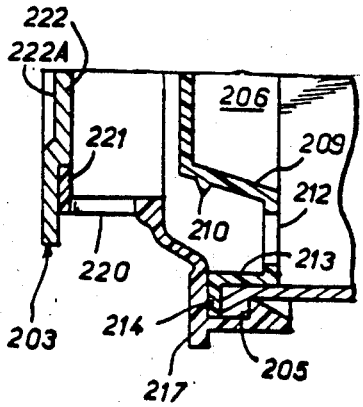

The closure devices of the embodiments of FIGS. 10–11 and 12 are particularly adapted for use as taps or cocks for fluid-carrying pipes or conduits.

In the embodiments of FIGS. 10 and 11 the closure device is secured to a pipe 201 having a radially outwardly extending flange 205. A one-piece molded plug 206 is received on the end of the pipe 201 and comprises an outer radial rim 214 connected to an axial sidewall 213, sealingly engaging the inner wall of the conduit 201, followed radially by a transverse wall 211. An outwardly projecting central boss extends from the transverse wall 211 and comprises a sidewall 209 defining a frusto conical surface of revolution having an annular sealing rib 210 remote from the transverse wall 211, and a central wall 208 joined to the sidewall 209.

The fixed member 2J comprises an annular interlocking portion 215 connected to a cylindrical wall 207 integral with the transverse wall 217. The fixed member 2J is sized and shaped to elastically clamp the outer radial rim 214 of the plug 206 against the flange 205 of pipe 201, the peripheral edges of the rim 214 and the flange 205 being in contact with the inner surface of the skirt 207.

The deformable membrane member 4C is non-perforated and is joined to the transverse wall 217 of the fixed member 2J at its outer periphery and cylindrical sidewall 218 of the movable member 3G at its inner periphery. The sidewall 218 has a downwardly opening discharge orifice 220 and is continued by an inturned flange 221. The operating member 222 forms the endwall of the movable member having a central recess 222A and the inturned flange 221 is received in the annular recess of the opposite side of the endwall. The central recess 222A in the outer face of the endwall permits the latter to be of substantially constant thickness throughout. The operating member 222 has oppositely radially projecting ears 223 (only one shown in FIG. 11) defining a grip member for facilitating manipulation of the operating member 222.

In the closed position in the top half of FIG. 10, the annular rib 210 is in sealing engagement with sidewall 218 and the axially inner end of the sidewall 218 sealingly engages the frustoconical sidewall 209 of the boss thereby defining double sealing action between the plug 206 and the movable member 3G. The tap is open by pulling the operating member 222 axially outwardly thereby reversing the configuration of the membrane member 4C to its second stable position, corresponding to the open position of the tap shown at the bottom half of FIG. 10. In the open position the fluid passageway is open from the interior of pipe 201 through port 212, the annular space between the plug and the membrane member 4C and out through the downwardly oriented orifice 220.

In the FIG. 12 embodiment there is also provided a closure device which operates as a tap or cock mounted on the end of a pipe or conduit 201. The fixed member 2K comprises an annular interlocking member 215A at the end of a cylindrical wall 207A which in turn is joined to a transverse wall 217A from which extends in this embodiment, a sidewall 240 with a beveled pouring lip. Instead of the plug, the fixed member 2K of the embodiment of FIG. 12 secures a simple valve sealing member 235 in place. The movable member in FIG. 12 is show as 3H. The valve seating member 235 comprises a rim 239 clamped between the transverse wall 217A and the flange 205 of the pipe 201 which is extended axially by a sidewall 238 which is followed by a transverse wall 237 from which a short axial throat 236 extends inwardly defining the effective aperture of the pipe 201. The annular edge zone between the transverse wall 235 and the axial throat 236 defines the actual valve seating sealingly cooperable with the inclined surface of the valve member 244 of wedge-shaped cross-section.

The membrane member 4D having one or more ports 253 extends inwardly from the transverse wall 217A to the valve member 244. The valve member 244 is disposed at the outer periphery of an annular transverse wall 241 extended axially by a hollow stem 242 with an inturned flange 252 at its axially outer end. A separate cap 243 is assembled by detenting to the axially outer end of the hollow stem 246 by means of frustoconical tip 251 connected to end wall 250 defining an outwardly opening annular groove 247 cooperable with the internal flange 252 of hollow stem 242. Near the outer periphery of the end wall 250 axially projects a cylindrical sidewall 248 with an inwardly beveled edge 249. The outer diameter of sidewall 248 and the inner diameter of sidewall 240 are sized to provide snug sealing engagement in the closed position of the tap.

In view of the above it will be understood that this embodiment provides two separate sealing zones in the closed position, namely between the valve member 244 and the associated valve seating on member 235 and between the nesting sidewalls 248 and 240 on the cap 243 and fixed member 2K respectively.

It is a preferred feature of all the embodiments other than that of FIG. 3 to mold the membrane member 4A–H in association with the fixed member and the movable member depending on the embodiment, in a position corresponding substantially to the closed position of the movable member. This will define a stable second position of the membrane member corresponding substantially to the closed position of movable member which is more marked than the opposite, first stable position. In addition to this advantage the valve means comes into abutment with the valve seating at a position of the membrane member intermediate the first and second stable positions and immediately above or before its molded configuration position so that the membrane member exerts an axial force against the movable member to enhance sealing contact between the valve member and the valve seating. In other words the membrane member biases the movable member into the closed position.

The above described and illustrated embodiments are given by way of example and are not intended to limit the scope of the invention. In general it will be possible to use features of any one of the embodiments in other embodiments. For example, it will be readily apparent to those skilled in the art that the liner of the FIG. 1 embodiment may be utilized in the embodiments of, e.g., FIGS. 2, 3 or 8, if sealing engagement is preferred between the valve member and a liner defining the valve seating rather than directly on the corresponding surface of the associated bottle.

Further, it will be readily appreciated that in the embodiments such as FIGS. 1 and 7 wherein a detented connection is provided between the stem of the operating member and the associated stopper or disc may be replaced by a heat seal, ultrasonic weld or other bonding means, such as illustrated in the FIG. 8 embodiment between the tubular stem and the lower endwall of the metering compartment.

In addition it will be noted that the check valve illustrated in the FIG. 5 embodiment may be employed in other embodiments wherever it is desired to prevent refilling of the receptacle.

It will also be readily appreciated by those skilled in that art that it will be possible to provide two separate zones of sealing engagement of associated valve members and valve seatings, such as illustrated in the FIGS. 10, 11 and 12 embodiments. Thus, for example, it is possible to provide a second stopper at the lower end of the stem in the FIG. 7 embodiment for sealing engagement with the inner surface of the bottle mouth. Similarly, it is possible to extend or shorten two effective sealing surfaces in the various embodiments along one or more surfaces without departing from the spirit and scope of the invention.

By the same token the tamperproof capsule illustrated in the FIG. 6 embodiment may be adapted to other embodiments wherever such a feature is desirable and may be used in lieu of a tamperproof seal of the type illustrated in the FIGS. 4 and 5 embodiments, or vice versa.

Finally the fixed member may be adapted to the collar, rim, bead, of any bottle, can, or other receptacle or container, such as illustrated in the various embodiments, without departing from the scope of the invention.

What is claimed is:

1. A closure device for a fluid receptacle having an outlet aperture, said closure device comprising a first generally annular member adapted to be fixed relative to the receptacle adjacent the aperture in the receptacle, coupling means for fixedly coupling the first annular member to the receptacle adjacent the aperture in the receptacle, a second generally annular member substantially coaxial with said first annular member, said second annular member being axially movable mounted between an axially inward closed position and an axially outward open position, said second annular member being disposed generally radially inwardly of said first annular member, both the open and closed positions being stable positions, an elastically deformable annular membrane member having one end fixed relative to said first annular member and another end of retaining said second annular member, said annular membrane member defining a flip-over position intermediate a first stable position and a second stable position corresponding to said open and closed positions of said second annular member, said membrane member having oppositely tapering frustoconical configuration in its first and second stable positions, said membrane member having its radially inner periphery joined to said second annular member and its radially outer periphery joined to said first annular member, portions of at least one of said members defining a fluid passageway for communication between the interior of the receptacle and the surroundings for discharging fluid from the receptacle when said second annular member is in the open position, and valve means defined by one of said second annular member and said membrane member co-operatable with a valve seating means for closing off the passageway in the closed position of said second annular member, said membrane member defining means for biasing said first annular member into its closed position, the vertical position of said membrane member in the closed position of said second annular member being between its first stable position and the position in which it is molded, and immediately above the latter, so that the said membrane member elastically forces said second annular member valve means axially against said valve seating means for tightly closing off said passageway. Wherein said first annular member comprises a generally cylindrical skirt, said second annular member having a central stem, a disc received around said stem and extending between the central stem and the inner wall of said cylindrical skirt, abutment means at the outer end of said stem for retaining said disc and resilient means operatively disposed between said disc and said second member to urge said disc into engagement with said abutment means, whereby said disc is depressible to grasp said stem to gain access to said second annular member to permit displacement from the closed position to the open position.

2. A closure device for a fluid-receptacle having an outlet aperture, said closure device comprising a first generally annular member adapted to be fixed relative to the receptacle adjacent the aperture in the receptacle, coupling means for fixedly coupling the first annular member to the receptacle adjacent the aperture in the receptacle, a second generally annular member substantially coaxial with said first annular member, said second annular member being axially movable mounted between an axially inward closed position and an axially outward open position, said second annular member being disposed generally radially inwardly of said first annular member, both the open and closed positions being stable positions, an elastically deformable annular membrane member having one end fixed relative to said first annular member and another end fixed relative to said first annular member and another end for retaining said second annular member, said annular membrane member defining a flip-over position intermediate a first stable position and a second stable position corresponding to said open and closed positions of said second annular member, said membrane member having oppositely tapering frustoconical configurations in its first and second stable positions, said membrane member having its radially inner periphery joined to said second annular member and its radially outer periphery joined to said first annular member, portions of at least one of said members defining a fluid passageway for communication between the interior of the receptacle and the surroundings for discharging fluid from the receptacle when said annular member is in the open position, and valve means defined by one of said second annular member and said membrane member co-operable with a valve seating means for closing off the passage way in the closed position of said second annular member and providing a waterproof seal therebetween, wherein said valve means comprises a stopper formed on said second annular member having a substantially cylindrical wall portion, said valve seating means comprising a complementary substantially cylindrical wall portion fixed relative to the receptacle, adjacent the aperture, and wherein the valve means further comprises a radiused connecting zone with said membrane member for sealingly engaging a complementary radiused zone on said valve seating means adjoining said complementary cylindrical wall portion, said second annular member comprises a central stem, a disc received around said stem and extending between the central stem and the inner wall of said cylindrical skirt, abutment means at the outer end of said stem for retaining said disc and said second member to urge said disc into engagement with said abutment means, whereby said disc is depressible to grasp said stem to gain access to said second annular member to permit displacement from the closed position to the open position.

3. A closure device for a fluid receptacle having an outlet aperture, said closure device comprising a first generally annular member adapted to be fixed relative to the receptacle adjacent the aperture in the receptacle, coupling means for fixedly coupling the first annular member to the receptacle adjacent the aperture in the receptacle, a second generally annular member substantially coaxial with said first annular member, said second annular member being axially movable mounted between an axially inward closed position and an axially outward open position, said second annular member being disposed generally radially inwardly of said first annular member, both the open and closed positions being stable positions, an elastically deformable annular membrane member having one end fixed relative to said first annular member and another end of retaining said second annular member, said annular membrane member defining a flip-over position intermediate a first stable position and a second stable position corresponding to said open and closed positions of said second annular member, said membrane member having oppositely tapering frustoconical configurations in its first and second stable positions, said membrane member having its radially inner periphery joined to said second annular member and its radially outer periphery joined to said first annular member, portions of at least one of said members defining a fluid passageway for communication between the interior of the receptacle and the surroundings for discharging fluid from the receptacle when said second annular member is in the open position, and valve means defined by one of said second annular member and said membrane member cooperable with a valve seating means for closing off the passageway in the closed position of said second annular member, the molded configuration of said membrane member substantially corresponding to said closed position of said second annular member, said membrane member defining means for biasing said first annular member into its closed position, the vertical position of said membrane member in the closed position of said second annular member being between its first stable position and the position in which it is molded, and immediately above the latter, so that the said membrane member elastically forces said second annular member valve means axially against said valve seating means for tightly closing off said passageway wherein said second annular member comprises a port along said fluid passageway, said valve seating being formed around said port, said membrane member forming a bellows connected axially between said first and second annular members, a portion of said bellows forming said valve means, said bellows being collapsed in said closed position or bringing said valve means into sealing engagement with said valve seating means for closing off said port in said first member.

* * * * *